United States Patent [19]

Rintoul

[11] 4,245,216

[45] Jan. 13, 1981

[54] ELECTRIC CRIBBAGE BOARD WITH COMMON HAND COUNT DISPLAY AND SELECTIVE ENTRY TO RESPECTIVE SETS OF GAME SCORE INDICATORS

[76] Inventor: Roy D. Rintoul, R.R. #2, Campbellville, Ontario, Canada, LOP 1B0

[21] Appl. No.: 30,410

[22] Filed: Apr. 16, 1979

Related U.S. Application Data

[63] Continuation-in-part of Ser. No. 833,475, Sep. 15, 1977, abandoned.

[51] Int. Cl.[3] ..... G08B 23/00; A63B 71/00; A63F 9/00

[52] U.S. Cl. ..... 340/323 R; 235/92 GA; 273/1 ES; 273/148 R; 273/DIG. 26

[58] Field of Search ..... 340/323 R; 273/1 T, 273/1 U, 139, 148 R, DIG. 26, 1 E, 1 ES; 235/90, 92 GA, 92 CA; 116/202, 222–225, 284, 309, 310

[56] References Cited

U.S. PATENT DOCUMENTS

| | | | |
|---|---|---|---|
| Re. 28,503 | 8/1975 | Townsend et al. | 340/323 R |
| 2,375,040 | 5/1945 | Satoris | 340/323 R |
| 3,189,888 | 6/1965 | Bradley | 273/148 R |
| 3,266,724 | 8/1966 | Johnson | 273/148 R |
| 3,797,010 | 3/1974 | Adler et al. | 340/323 R |

*Primary Examiner*—John W. Caldwell, Sr.
*Assistant Examiner*—James J. Groody
*Attorney, Agent, or Firm*—Hirons, Rogers & Scott

[57] ABSTRACT

An electric cribbage board wherein the score for each shown by the illumination of a respective one of a number of lightable indicator devices forming a respective "track" or "street". The board is arranged to illuminate two successive devices in each track, the leading device indicating the total game score, while the trailing device indicates the just preceding total score. Facilities are provided for displaying and therefore checking a hand count before it is added to the respective total score count for each player so as to light the appropriate indicator. The board avoids the need for mental computation as is required with completely manual cribbage boards, or known electro-mechanical cribbage boards, and thereby assists in eliminating incorrect hand and total score counts during playing of the card game of cribbage.

10 Claims, 2 Drawing Figures

ELECTRIC CRIBBAGE BOARD WITH COMMON HAND COUNT DISPLAY AND SELECTIVE ENTRY TO RESPECTIVE SETS OF GAME SCORE INDICATORS

CROSS-REFERENCE TO RELATED APPLICATION

The present application is a continuation-in-part of my application Ser. No. 833,475, filed Sept. 15th 1977 and now abandoned.

FIELD OF THE INVENTION

This invention is concerned with improvements in or relating to electric cribbage boards for use in the playing of the card game of cribbage.

REVIEW OF THE PRIOR ART

The well-known two-handed card game of cribbage usually involves the use of a cribbage board for keeping the score. Conventionally the game is played for a total of 120 points, and a typical mechanical board as used hitherto is therefore provided with two parallel tracks or streets, each of 120 apertures, for receiving score-indicating pegs. As each hand is played and scored the player moves two pegs along his respective track, the first or leading peg showing the total score count for the game, while the spacing of the second or trailing peg from the first peg indicates the count of the just-played hand. Thus, each player announces his hand count to the other and then, upon agreement, can withdraw the trailing peg, count along from the leading peg the number of apertures equal to the hand count, and insert the peg in the new aperture, so that the trailing peg is now the leading peg, and vice versa. In any game requiring such mental calculation and manual manipulation there is always considerable opportunity for error and consequent controversy between the players.

Other forms of cribbage board have been proposed and a prior novelty search carried out on my behalf before the preparation and filing of this application revealed U.S. Pat. Nos. 2,375,040; 3,189,888 and 3,266,724.

U.S. Pat. No. 2,375,043 issued to Satori describes an electric cribbage board employing manually-moved pegs of electrically-conducting material. Certain of the board apertures have electric contacts disposed beneath them and insertion of the pegs in these apertures completes a respective electric circuit causing a corresponding lamp to light. Three different lights are provided and, depending upon which becomes lit upon inserting the peg, the player either receives a "benefit", or suffers a "stall" or a "penalty".

U.S. Pat. No. 3,189,888 issued to Bradley provides an electromechanical cribbage board having two counting tracks, each end consisting of a row of neon lights. Two scoring actuator panels are provided, one for each player, at opposite ends of the board, each including a tens switch and a unit switch, the setting of the switches determining which light is lit in his track. Each player mentally computes his last hand count and then enters it by moving the appropriate switches on from their last set position.

U.S. Pat. No. 3,266,724 issued to Johnson provides a mechanical cribbage board in which the pegs are permanently installed in the holes and are depressed into their holes to indicate the total score.

British Pat. No. 1,325,644 issued to Edward J. Sweeney describes an apparatus for displaying the point scores of individual judges at a sporting contest, such as a boxing or skating contest, and for displaying the cumulative scores for each contestant. The equipment consists of a master console and individual score booths for the judges, the points allocated to each contestant being totalled at the master console and displayed on a score board located over the competition area.

DEFINITION OF THE INVENTION

It is the object of the present invention to provide a new electric cribbage board.

It is a more specific object to provide such a board permitting each player to display and verify each hand count before it is added to the previous total score count to produce the new total score count.

It is a further object to provide such a board which eliminates the need for mental calculation in moving from one total score count to the next, thereby avoiding one serious source of contention between players.

In accordance with the present invention there is provided an electric cribbage board comprising:

at least two sets of a series of indicators for displaying a score-count of a respective player by illumination of a selected one of the indicators of the series in the set;

a common hand count display means for all of the players;

player-operable input means for causing the hand count display means to display a hand-count and for erasing a hand-count at will from the hand-count display means;

separate player-operable means for each player enabling a player to cause said input means to pass a hand-count displayed by the common hand count display means selectively to a selected one of the respective set of indicators for that player, thereby causing said set of indicators to record and display the total score-count of the respective player;

said enabling means including circuit means to cause the selected indicator in said selected set of indicators to be illuminated thereby representing the said total score-count.

DESCRIPTION OF THE DRAWINGS

A particular preferred embodiment of the invention will now be described, by way of example, with reference to the accompanying diagrammatic drawings wherein.

DESCRIPTION OF THE PREFERRED EMBODIMENT

Figure 1:
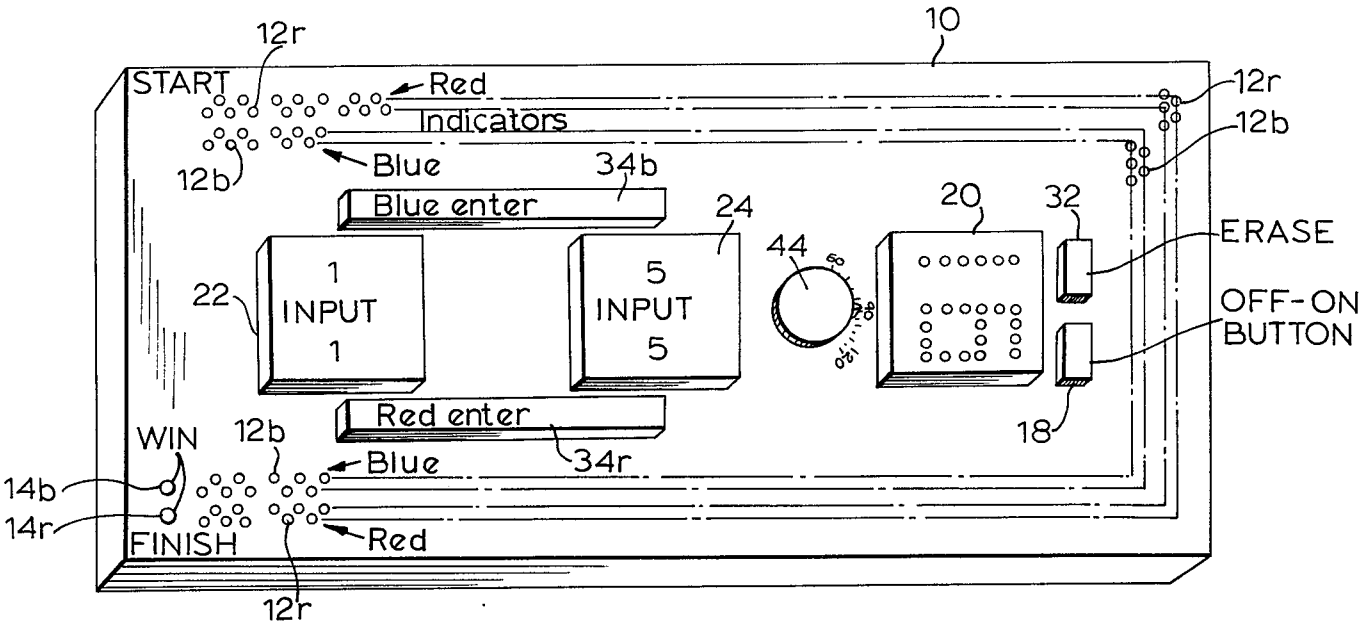
FIG. 1 is a plan view above of the board's exterior to show the arrangement thereof.

Referring now specifically to FIG. 1 board 10 shown therein follows the physical layout of a conventional mechanical cribbage board as far as possible, but with each peg-receiving aperture replaced by a respective low-intensity light-emitting indicating device 12, such as a neon lamp or light-emitting diode. Thus, two tracks or streets, each of 120 indicators, are provided, and these may be placed in groups of five, as is conventional with mechanical boards. Each track terminates in a respective win indicator device **14*b* or 14*r***, and conveniently the indicator devices of one track emit blue light, while the devices of the other track emit red light, so that there is no possibility of confusion between them. Any other pair of readily distinguished colors can of course be used, depending for example upon the availability and natural emitting color of the selected devices. For convenience in description devices, etc. associated and operative with the blue track will have the suffix *b*, while the equivalent devices, etc. associated with the red track will have the suffix *r*. Thus, the indicator devices of the blue track are referenced 12*b*, while those of the red track are referenced 12*r*.

Figure 2:
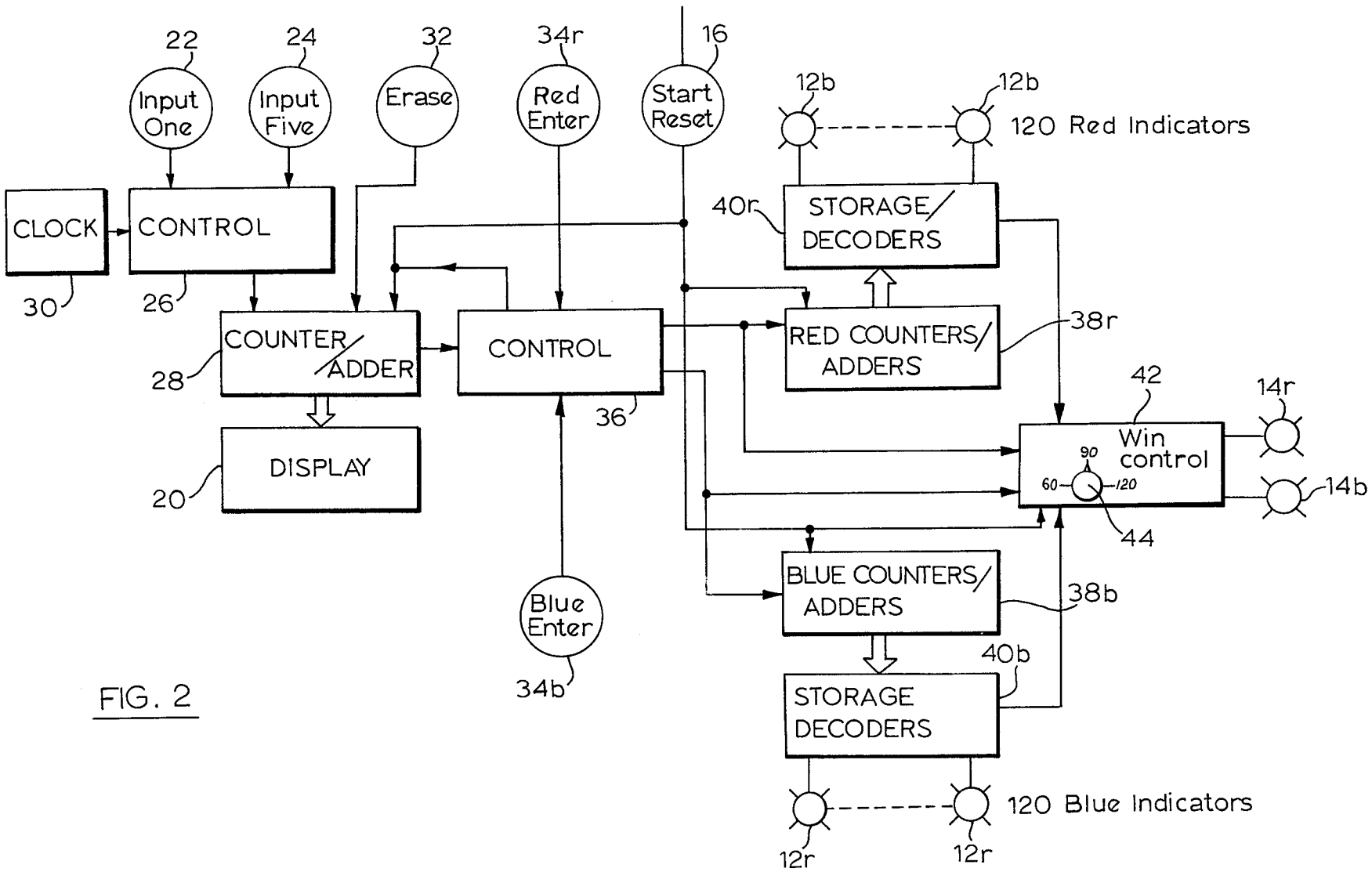
FIG. 2 is a block circuit diagram to show the circuitry of the board of FIG. 1.

Referring now also to FIG. 2 the circuit is switched on and off by means of a switch 16 operated by a push-button 18 on the top surface of the board, this switch controlling the supply of power from a source (not shown) which may be a battery or suitable 110 volt supply. An illuminated numerical display unit 20 is mounted on the board and displays a number count produced by operation of two large push-button switches 22 and 24, each operation of switch 22 causing a count of one, while each operation of switch 24 causes a count of five. The game of cribbage requires a display up to the value 29, and this is of course readily available with current display devices; the number "16" shown is an example only of a typical individual hand count. Thus, each operation of switch 22 by either player causes operation of a control module 26 to supply a "one" count to a counter/adder module 28, that in turn feeds the necessary signal to the display unit to display the number so far counted by the module 28. Similarly each operation of the switch 24 causes operation of the modules 26 and 28 to add a five count to the figure displayed by the display 20. A clock 30 synchronises the operation of the entire circuit by feeding appropriate precisely spaced timing signals into the control circuit 26, and thence to the other parts of the circuit, as will be apparent to those skilled in the art.

Upon conclusion of a hand the respective player operates the switches 22 and 24 until his hand count is displayed. If there is any error in counting, or if the opponent does not agree with the score and the player aquiesces in the objection, then the display is erased by operation of erase button 32, which feeds an appropriate erase signal to the counter/adder module 28; the agreed hand count is then entered. Upon agreement of the hand count as displayed, then either the blue player will depress blue enter switch 34*b*, or the red player will depress red enter switch 34*r*. Each switch gives a respective signal to a control module 36 receiving a hand count signal from the module 28, causing the control module to transmit the hand count signal either to a red counter/adder module 38*r*, or to a blue counter/adder module 38*b*, while at the same time erasing the display on the display unit 20.

Each counter/adder module controls a respective storage decoder 40*b* or 40*r* that in turn controls the illumination of the required indicator devices. Upon insertion of the first hand count of a game only one indicator device is illuminated. As with the prior art mechanical board, upon the insertion of the second hand count, in each "street" two indicators will be illuminated, the "leading" indicator showing the total game score, while the "trailing" indicator shows the immediately preceding total game score, so that the leading indicator leads the trailing indicator by the hand score just entered. The insertion of any subsequent hand count will cause operation of the storage decoder to illuminate a new "leading" indicator and to extinguish the former "trailing" indicator, the former "leading" indicator becoming the new "trailing" indicator, corresponding to the "leap-frog" movement of the pegs of a mechanical board.

The red and blue hand count signals from the control module 36 are also fed to a win control module 42 which may be preset for any total game count, for example, either 60, 90 or a maximum of 120 points. When the win control module 42 detects that the total game score is a particular track has reached the preset value it lights the respective win indicator 14*b* or 14*r* indicating a win for that player or team. The electric board is conveniently reset to start condition by operation of the switch 16. The board can be arranged to have the fixed maximum score of 120 that is conventional for cribbage or the score can be selected at will by operation of a hand control 44.

The body of the board can be of moulded plastic, and with modern MS1 and/or LS1 integrated circuits the necessary circuit modules can be made of a size such as to fit into the body of a hand-held board. The board is not of course limited as to size and can range from the said hand-held size to one large enough to constitute a game table on which the game can be played. The specific layout of the board will of course vary with the designer's conception of a suitable and attractive layout, although there is now a certain tradition as to layout which prospective purchasers may wish to have observed. Although the board particularly described is arranged for operation by two players or teams of players it will be apparent that more than two players or teams can be accomodated with a single board by the provision of the required number of tracks of indicators, enter switches 34, counter/adders 28, storage decoders 40 and win indicators 14, etc. In a specific embodiment of the disclosed circuit the counter/adders 28 can, for example, be of type 7483, the counters 38 can be of type 74192, while the decoders 40 can be of type 7447.

I claim:

1. An electric cribbage board comprising:

at least two sets each of a series of indicators for displaying a score-count of a respective player by illumination of a selected one of the indicators of the series in the set;

a common hand count display means for all of the players;

player-operable input means for causing the hand count display means to display a hand-count and for erasing a hand-count at will from the hand-count display means;

separate player-operable means for each player enabling a player to cause said input means to pass a hand-count displayed by the common hand count display means selectively to a selected one of the respective set of indicators for that player, thereby causing said set of indicators to record and display the total score-count of the respective player;

said enabling means including circuit means to cause the selected indicator in said selected set of indicators to be illuminated thereby representing the said total score-count.

2. A cribbage board as claimed in claim 1, wherein said circuit means of the enabling means cause two selected successive indicators in each set of indicators to be illuminated thereby representing a total score count and the immediately preceding total score count upon feeding the displayed hand count to the said set.

3. A cribbage board as claimed in claim 1, wherein said input means includes means for entering the hand-count in multiples of ones and fives, the sum entered by operation of the entering means being visually numerically displayed by the display means.

4. A cribbage board as claimed in claim 1, wherein said sets of indicators are arranged in parallel tracks on said cribbage board surrounding said hand-count display means.

5. A cribbage board as claimed in claim 1, wherein each set of indicators is distinguishable by color from each other set, each set displaying the score count of a respective player; and said circuit means of the enabling means comprise independent circuit modules, one for each set of indicators, each circuit module including a respective control means which when activated by the respective player passes a signal representing the respective hand-count to the respective set of indicators.

6. A cribbage board as defined in claim 1, further including, a win indicator associated with each set of indicators, wherein said circuit means of the enabling means receives said total score count and compares it with a game win total score, said circuit means causing the respective win indicator to be illuminated in response to said circuit means receiving an updated total score-count at least equal to said game win total score.

7. A cribbage board as claimed in claim 2, wherein said player-operable input means includes means for entering the hand-count in multiples of ones and fives, the sum entered by operation of the entering means being visually numerically displayed by the display means.

8. A cribbage board as claimed in claim 2, wherein said sets of indicators are arranged in parallel tracks on said cribbage board surrounding said hand-count display means.

9. A cribbage board as claimed in claim 2, wherein each set of indicators is distinguishable by color from each other set, each set displaying the score count of a respective player; and said circuit means of the enabling means comprise independent circuit modules, one for each set of indicators, each circuit module including a respective control means which when activated by the respective player passes a signal representing the respective hand-count to the respective set of indicators.

10. A cribbage board as defined in claim 2, further including, a win indicator associated with each set of indicators, wherein said circuit means of the enabling means receives said total score count and compares it with a game win total score, said circuit means causing the respective win indicator to be illuminated in response to said circuit means receiving an updated total score-count at least equal to said game win total score.

* * * * *